US005283412A

United States Patent [19]

Gouardo et al.

[11] Patent Number: 5,283,412

[45] Date of Patent: Feb. 1, 1994

[54] TEMPERATURE-MEASURING DEVICE FOR AN INDUCTION-TYPE COOKING APPLIANCE AND APPLIANCE HAVING SUCH A DEVICE

[75] Inventors: Didier Gouardo, Saran; Serge Boyer; Pierre Pitot, both of Orleans, all of France

[73] Assignee: Compagnie Europeenne Pour l'Equipment Menager - Cepem, St. Jean de Ruelle, France

[21] Appl. No.: 552,097

[22] Filed: Jul. 13, 1990

[30] Foreign Application Priority Data

Aug. 4, 1989 [FR] France ..... 89 10527

[51] Int. Cl.[5] ..... H05B 5/04

[52] U.S. Cl. ..... 219/627; 219/450; 219/452; 219/672; 374/165; 374/185

[58] Field of Search ..... 219/10.77, 10.493, 10.491, 219/10.79, 502, 450, 452, 216; 374/165, 124, 130, 185, 155, 114

[56] References Cited

U.S. PATENT DOCUMENTS

| | | | |
|---|---|---|---|
| 3,191,003 | 6/1965 | Yohe | 219/10.491 |
| 3,530,499 | 9/1970 | Schroeder | 219/10.491 |
| 3,624,352 | 11/1971 | Deaton | 219/449 |
| 3,710,062 | 1/1973 | Peters, Jr. | 219/10.491 |
| 3,786,220 | 1/1974 | Harnden, Jr. | 219/10.49 |
| 3,796,850 | 3/1974 | Moreland, II et al. | 219/10.491 |
| 3,843,857 | 10/1974 | Cunningham | 219/10.493 |
| 4,013,859 | 3/1977 | Peters, Jr. | 219/10.491 |
| 4,194,826 | 3/1980 | Lewis | 219/216 |
| 4,319,109 | 3/1982 | Bowles | 219/10.49 |
| 4,499,368 | 2/1985 | Payne | 219/452 |
| 4,665,292 | 5/1987 | Payne | 219/450 |

FOREIGN PATENT DOCUMENTS

| | | |
|---|---|---|
| 0082768 | 6/1983 | European Pat. Off. . |
| 1396923 | 3/1965 | France . |
| 2260249 | 8/1975 | France . |
| 2095834 | 10/1982 | United Kingdom . |

*Primary Examiner*—Bruce A. Reynolds
*Assistant Examiner*—Tu Hoang
*Attorney, Agent, or Firm*—Oblon, Spivak, McClelland, Maier & Neustadt

[57] ABSTRACT

A temperature-measuring device for an induction-type cooking appliance is disclosed with a heat measuring device for an induction-type cooking hob including a heat conductor for measuring the temperature of a sauce pan or its contents independently of its diameter or its bottom surface configuration. A heat conductor includes modifications which minimize the effects of currents provided by the induction heating. The device allows for the measurement of temperature during induction heating.

8 Claims, 7 Drawing Sheets

TEMPERATURE-MEASURING DEVICE FOR AN INDUCTION-TYPE COOKING APPLIANCE AND APPLIANCE HAVING SUCH A DEVICE

BACKGROUND OF THE INVENTION

The invention relates mainly to a temperature-measuring device for an induction-type cooking appliance and to an appliance comprising such a device.

1. Description of the prior art

There are known devices for measuring the temperature of vessels heated by induction, for example on a cooking hob. Such a cooking hob comprises a plane plate, for example made of glass-ceramic, on which a saucepan can be placed. The temperature of the content of the saucepan is to be measured, for example for the purpose of a servo-control. The measuring device must allow for the fact that the bottom of the saucepans is not necessarily perfectly plane and that saucepans of various diameters can be used. If the saucepan has a concave or convex bottom, the point sensors located at the center risk not coming in contact with a saucepan and therefore giving incorrect measurements.

Furthermore, where an induction-type cooking hob is concerned, even with a flat-bottomed saucepan maximum heating is obtained with a diameter corresponding to half the diameter of the inductor. At this location, the temperature of the bottom of the saucepan is higher than the temperature of its content, for example oil, which it is intended to be able to measure. In contrast, the temperature is lower at the center and edge of the saucepan. It is in the neighborhood of that of the content of the saucepan.

The point sensors arranged on the periphery risk being incapable of measuring the temperature of saucepans of small diameter.

To solve this problem, low-power induction-type cooking hobs have been equipped with aluminum plates put in thermal contact with the temperature sensors. This aluminum plate of high thermal conductivity makes it possible to average the temperature out over a larger surface.

The present invention is based on the discovery that temperature measurements using the device of known type comprising an aluminum plate have been falsified by the heating of the said aluminum plate by the current induced by the inductor. This is especially serious when the measurement of the temperature serves for a servo-control of the latter. In fact, the induction currents heat the aluminum plate and falsify the measurement of the temperature which, in turn, regulates the induction-current power. The result is a completely erratic behavior.

Furthermore, it is absolutely impossible to use aluminum plates for induction-type cooking hobs of normal power or high power. Indeed, at a high power the heating of the aluminum plate risks damaging or destroying the temperature sensors and the inductor. Moreover, at a high power, assuming that the sensor will still be capable of functioning, the measured temperature is mainly a function of the currents induced in the aluminum plate and is influenced only slightly by the cooking temperature.

SUMMARY OF THE INVENTION

The object of the present invention is to measure accurately the temperature of a vessel or of its content heated by an induction-type cooking hob, whatever the form of this vessel.

To achieve this, the device according to the present invention comprises a temperature detector connected thermally to a heat conductor comprising means making it possible to reduce the electromagnetic power absorbed by the heat conductor, for example by reducing the induced current intensity. For that purpose, preferably the circumferential electrical resistance is increased, whilst at the same time attempting to disturb the radial thermal conduction as little as possible.

The subject of the invention is mainly a device for measuring the temperature of a vessel or of a product heated by an induction-type cooking appliance comprising a detector connected thermally to a heat conductor, wherein the heat conductor comprises means for increasing the circumferential electrical resistance, whilst at the same time minimizing the reduction of the radial thermal conduction.

Another subject of the invention is a device wherein the means for increasing the circumferential electrical resistance are cutouts.

Yet another subject of the invention is a device wherein the sensor is a sensor with a negative temperature coefficient (NTC).

A further subject of the invention is a device wherein the sensor is a diode sensor.

A subject of the invention is also a device wherein the heat conductor comprises tongues.

A subject of the invention is also a device wherein the tongues have a width substantially equal to 2 mm.

A subject of the invention is also a device wherein the heat conductor is made of aluminum.

A subject of the invention is also a device wherein the heat conductor is made of copper.

Another subject of the invention is a cooking hob comprising at least one inductor and a regulating device regulating the intensity, voltage and/or frequency of the current supplied to the inductor, defined in that it comprises a temperature-measuring device.

Another subject of the invention is a cooking hob defined in that it comprises control means, and in that the regulating device servo-links the temperature of a vessel or its content to a nominal value according to the temperature measurements made by the temperature-measuring device.

Yet another subject of the invention is a process for producing a device for measuring the temperature of a vessel or of a product heated by an induction-type cooking appliance, defined in that it comprises the following steps:

- determining the currents which would be induced by an inductor in a heat conductor placed against this inductor as a function of the geometry and the materials used;
- producing the heat conductor of a geometry and/or with materials minimizing its heating by the inductor, whilst at the same time optimizing the thermal conduction;
- putting the heat conductor in thermal contact with a temperature sensor located near the inductor.

BRIEF DESCRIPTION OF THE DRAWINGS

The invention will be better understood from the following description and from the accompanying figures given as non-limiting examples, of which.

DESCRIPTION OF THE PREFERRED EMBODIMENTS

In FIGS. 1 to 11, the same references are used to designate the same elements.

Figure 1:
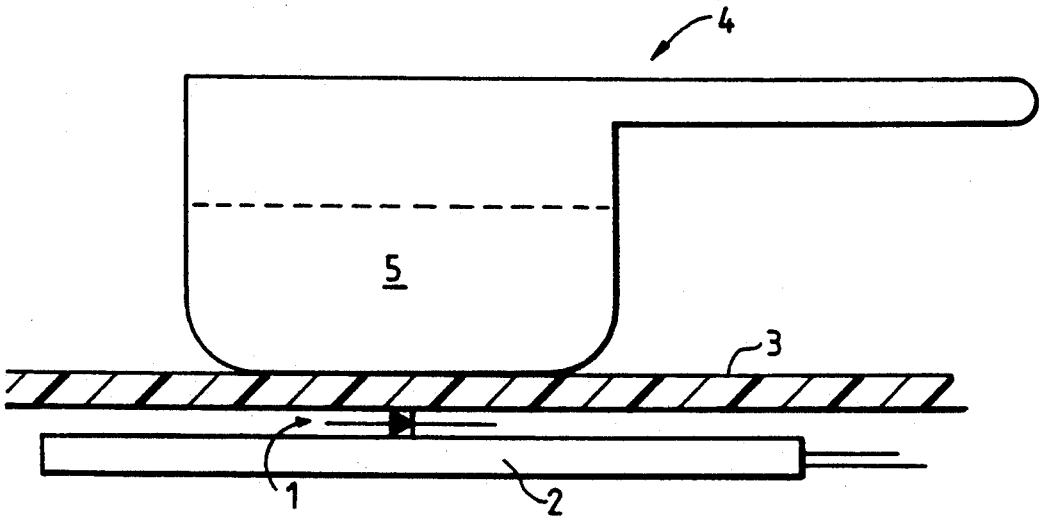
FIG. 1 (PRIOR ART)
FIGS. 1 to 3 are diagrams illustrating the disadvantages of the prior art.
Figure 2:
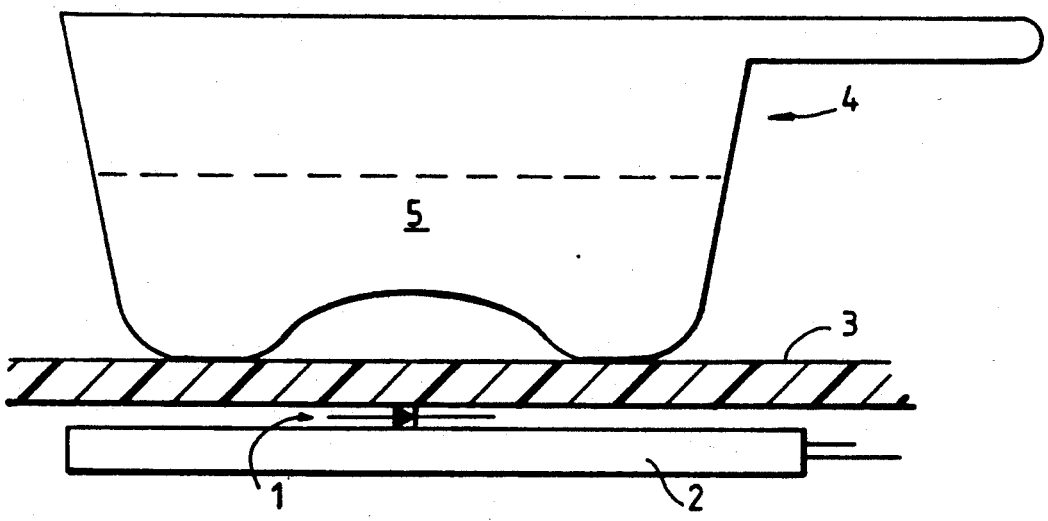
FIG. 2 (PRIOR ART)

An induction-type a cooking hob of known type can be seen in FIG. 1. The cooking hob comprises an inductor 2, a temperature sensor 1 and a support 3 for a saucepan 4, for example a glass-ceramic plate.

The inductor 2 through which a current passes is intended for generating in the saucepan 4 currents which will cause a rise of the temperature of the content 5 of the saucepan 4 as a result of the Joule effect. The temperature sensor 1 is intended for measuring the temperature of the content 5 of the saucepan 4, of the saucepan 4 or of the glass-ceramic plate 3. The temperature sensor 1 makes it possible to servo-link the temperature to a nominal value fixed by the control members or to a given heating sequence or trigger an alarm signal intended to prevent any contact of the hand with a plate which is still hot. The servo-control of the temperature makes it possible to obtain the desired cooking and prevent the saucepan from being damaged.

When there is a saucepan 4 with a plane bottom, the sensor 1 located at the center of the inductor 2 can supply a signal characteristic of the temperature of the content 5 of the saucepan 4. However, as can be seen, for example, in FIG. 2, saucepans often have a concave bottom. In this case, it is likely that the temperature sensor 1 will be located on a part of the glass-ceramic plate 3 which is not in contact with the bottom of the saucepan 4. In such a case, the signal supplied by the sensor 1 will no longer be characteristic of the temperature of the content 5 of the saucepan 4. In fact, the temperature of the sensor 1 risks being substantially lower than the temperature of the content 5 of the saucepan 4.

Figure 3:
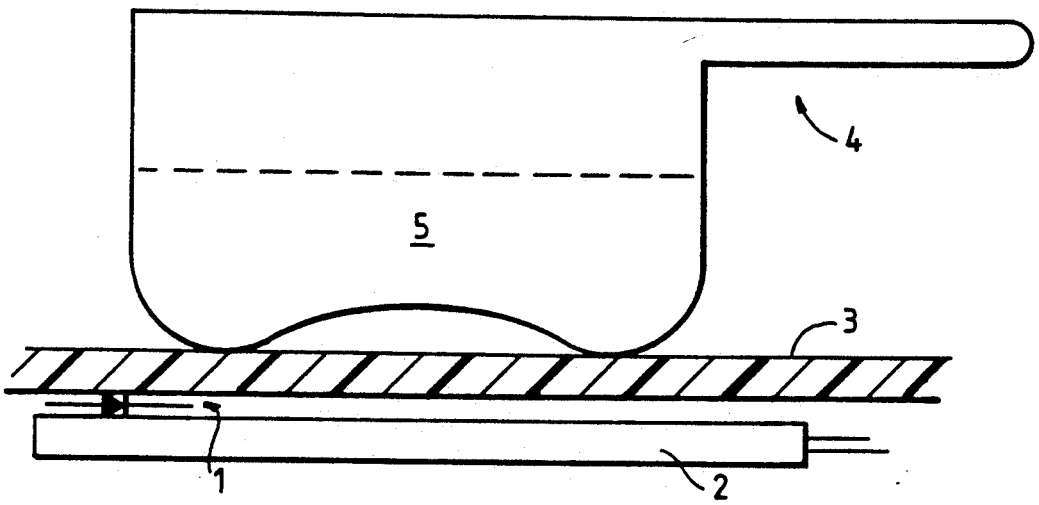
FIG. 3 (PRIOR ART)

The problem encountered with a temperature detector located on the periphery of the inductor 2 can be seen in FIG. 3. Such a detector accurately measures the temperature of the content 5 of the saucepan 4 of large diameter, even if its bottom is concave. But the sensor 1 is completely ineffective where saucepans of small diameter are concerned.

Figure 4:
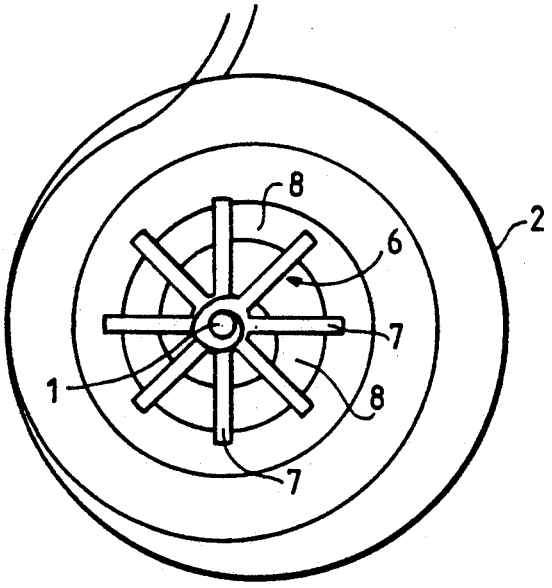
FIG. 4 is a diagram of a first exemplary embodiment of the device according to the present invention.

A first exemplary embodiment of a temperature device according to the present invention can be seen in FIG. 4. The temperature sensor 1 is placed on the inductor 2. The temperature sensor 1 is advantageously a diode with a negative temperature coefficient (NTC). However, the use of other temperature sensors, particularly sensors with a positive temperature coefficient, thermocouples or thermoresistors, do not depart from the scope of the present invention. A thermoconductor 6 is put in thermal contact with the sensor 1. It is possible to ensure the electrical insulation of the thermoconductor relative to the inductor 1 in order to guarantee the safety of the users. This electrical insulation will consist, for example, of a thin dielectric film or a heat-conducting grease so as not to disturb the thermal conduction. It is important to minimize the heating of the thermoconductor 6 as a result of the electromagnetic radiation of the inductor 2. It is possible, for example, to use thermal conductors which are not electrical conductors of the heat-conducting type. However, it is advantageous to use metal components, for example plates of aluminum, brass, copper or copper alloy. A reduction of the heat induced in the inductor 2 is obtained by the choice of the material and, above all, of the geometry of the thermal conductor 6. In the example illustrated in FIG. 4, the inductor 2 induces circumferential currents. In such an instance, the circumferential electrical resistance of the conductor 6 is increased so as to reduce the intensity of the induced currents. In the example illustrated in FIG. 4, the increase in the resistance is caused by radial cutouts 8. In the example illustrated in FIG. 4, the thermal conductor 6 has the form of a star comprising radial tongues 7 ensuring thermal conduction. In the example illustrated in FIG. 4, the thermal conductor 6 has a thickness of a few tenths of a millimeter. However, to limit the current induction in the heat conductor 6, it is possible to use insulator sheets internally interleaved at least partially with metal plates. It is thus possible to use metal plates the total thickness of which is greater, thereby ensuring better conduction, whilst at the same time preventing current induction in the thickness of the thermal conductor 6. Conductive braids can also be used to produce the heat conductor.

For the proper functioning of the temperature-measuring device according to the present invention, it is essential that at least part of the thermal conductor be covered by the vessel of which the temperature is to be measured. Advantageously, the diameter of the thermal conductor is of the same order as that of the saucepan of smallest diameter which it is intended to be able to use. However, if part of the thermal conductor 6 is not covered by the saucepan, insofar as it is the hottest part which determines the temperature to which the sensor 1 is brought, the measurement is disturbed only slightly.

Figure 5:
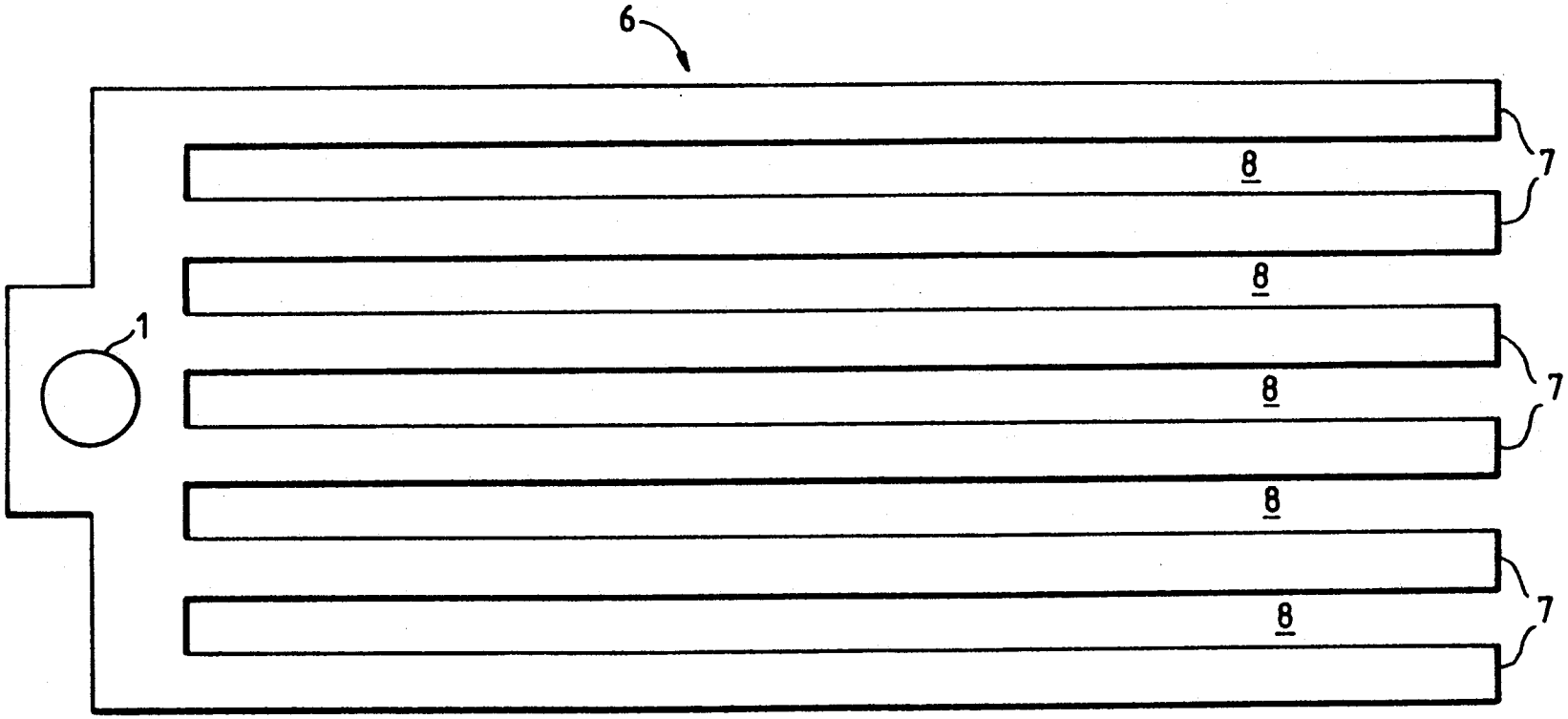
FIG. 5 is a second exemplary embodiment of the device according to the present invention.

The preferred exemplary embodiment of the device according to the present invention can be seen in FIG. 5. In the device of FIG. 5, the temperature sensor 1 is located on a widening of the base of the thermal conductor 1. Six parallel tongues 7 separated by five cutouts 8 extend from this base. In the preferred exemplary embodiment, the base has a thickness of 4 mm, its widening has a thickness of 3.5 mm, and each tongue 7 and cutout 8 has a width of 2 mm. The temperature sensor 1 is, for example, placed near the edge of the inductor 2. For embodiments in which the sensor 1 is to be placed at the center of the inductor 2 (not shown in FIG. 5), it may be advantageous to use a thermal conductor 6 additionally comprising six other tongues 7 arranged symmetrically in relation to the temperature sensor 1.

Figure 6:
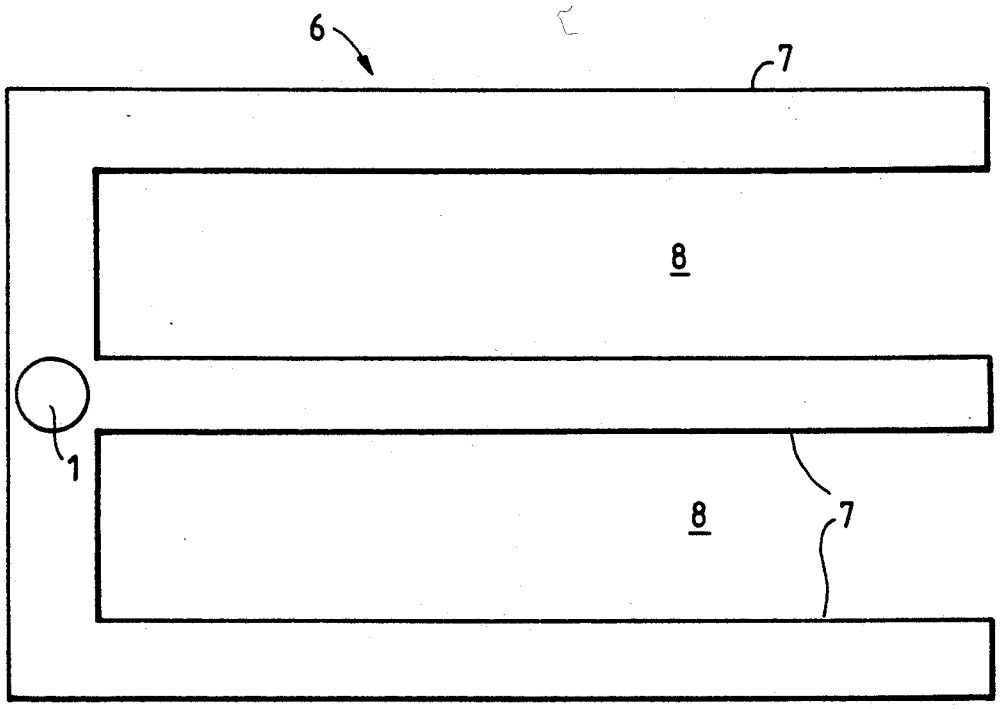
FIG. 6 is a third exemplary embodiment of the device according to the present invention.

An alternative embodiment of the device according to the present invention, comprising three tongues 7 separated by cutouts 8, can be seen in FIG. 6. The temperature sensor 1 is located on the common base of the three tongues.

Figure 7:
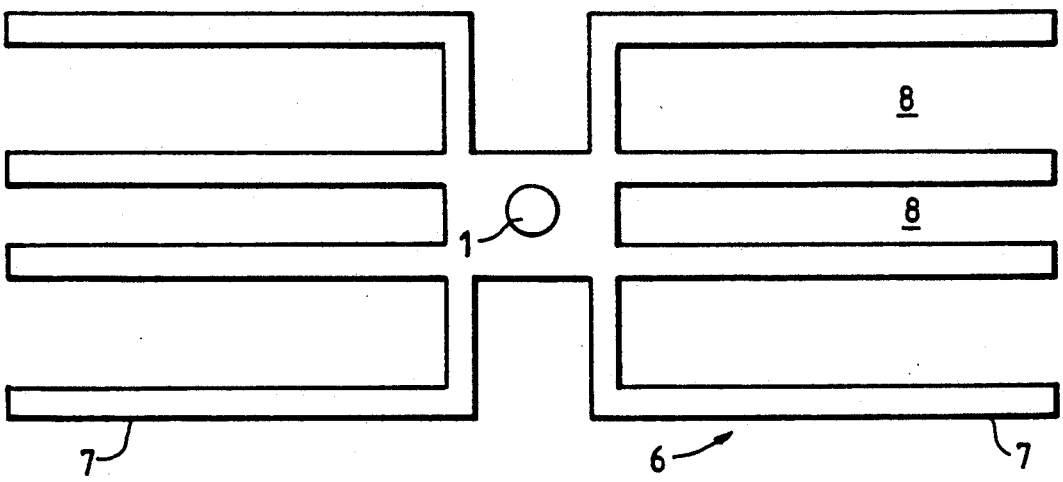
FIG. 7 is a fourth exemplary embodiment of the device according to the present invention.

An exemplary embodiment of the device according to the present invention, comprising two sets of four tongues 7 arranged symmetrically in relation to the temperature sensor 1, can be seen in FIG. 7. This assembly is intended to be placed at the center of the inductor 2 (not shown in FIG. 7).

Figure 8:
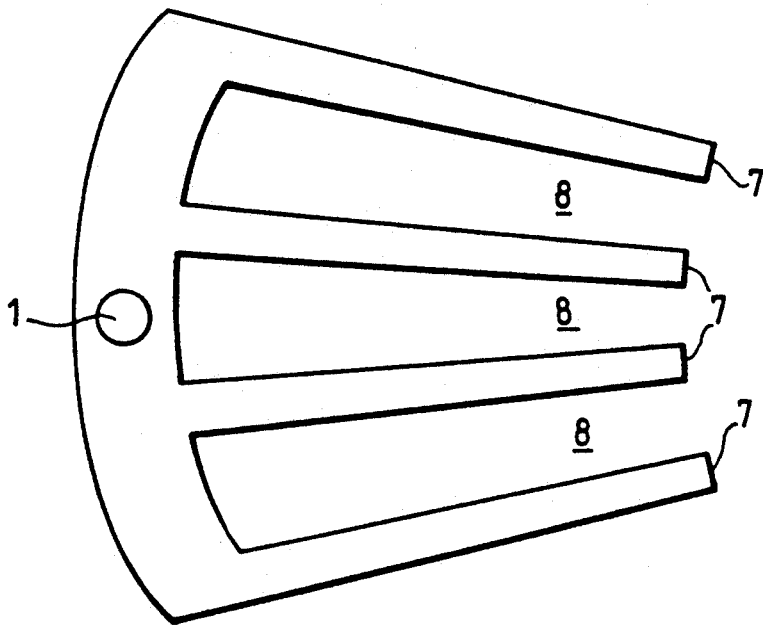
FIG. 8 is a fifth exemplary embodiment of the device according to the present invention.

An exemplary embodiment of the device according to the present invention, comprising four tongues 7 extending from a circular base, can be seen in FIG. 8. The temperature sensor 1 is located on the circular base. The circular base is arranged either on the edge of the inductor 2 (not shown in the figure) or concentrically relative to this edge.

Figure 9:
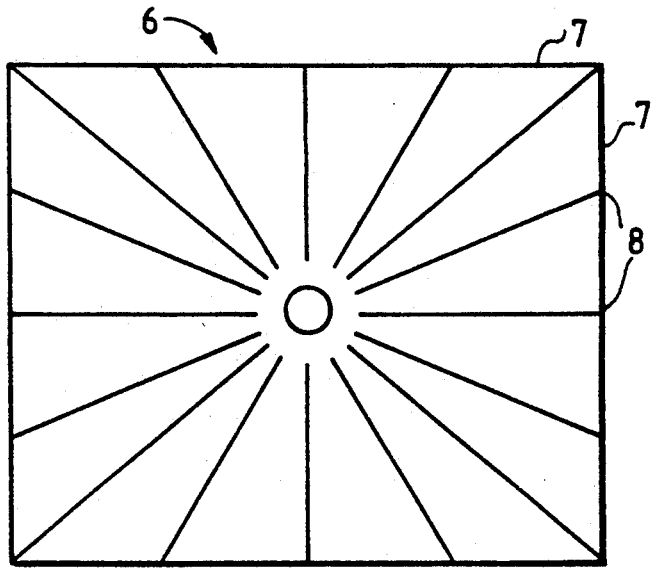
FIG. 9 is a sixth ,exemplary embodiment of the device according to the present invention.

An exemplary embodiment of the device according to the present invention, in which the cutouts 8 have the form of grooves of small thickness, can be seen in FIG. 9. In the example illustrated in FIG. 9, the thermal conductor 6 is a simple plate in which radial grooves have been made. The temperature sensor 1 is located at the center of the plate. It is possible, of course, to use circular plates, without departing from the scope of the present invention.

Figure 10:
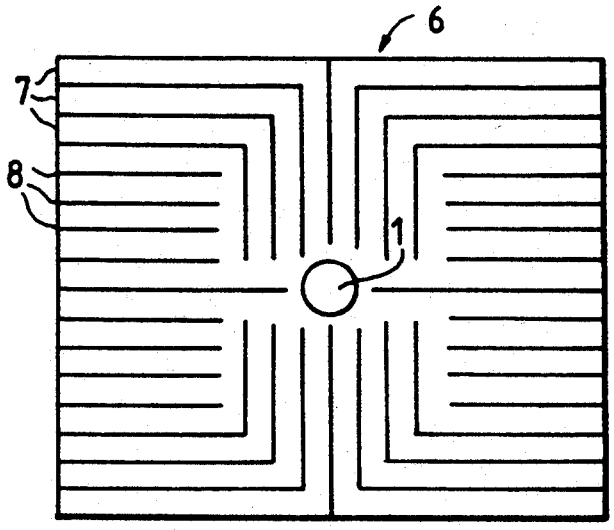
FIG. 10 is a seventh exemplary embodiment of the device according to the present invention.

An exemplary embodiment of the plates comprising grooves 8 forming tongues 7 of a constant width of typically 2 mm can be seen in FIG. 10. The temperature sensor 1 is located at the center of the thermal conductor 6.

It goes without saying that the use of a plurality of thermal conductors connected thermally to the same temperature sensor does not depart from the scope of the present invention. Likewise, a single tongue which will minimize the heating by the induced currents by virtue of its elongate form can be used.

It goes without saying that means other than the cutouts 8 can be used to reduce the energy absorbed by the heat conductor 6. For example, the resistivity of the heat conductor 6 can be varied locally or generally. For example, heat conductors of very low resistance, for example made of copper or silver, are used in order to reduce the Joule effect losses. In another exemplary embodiment, the resistivity of the heat conductor 6 is increased locally so as to reduce the induced current intensity.

Figure 11:
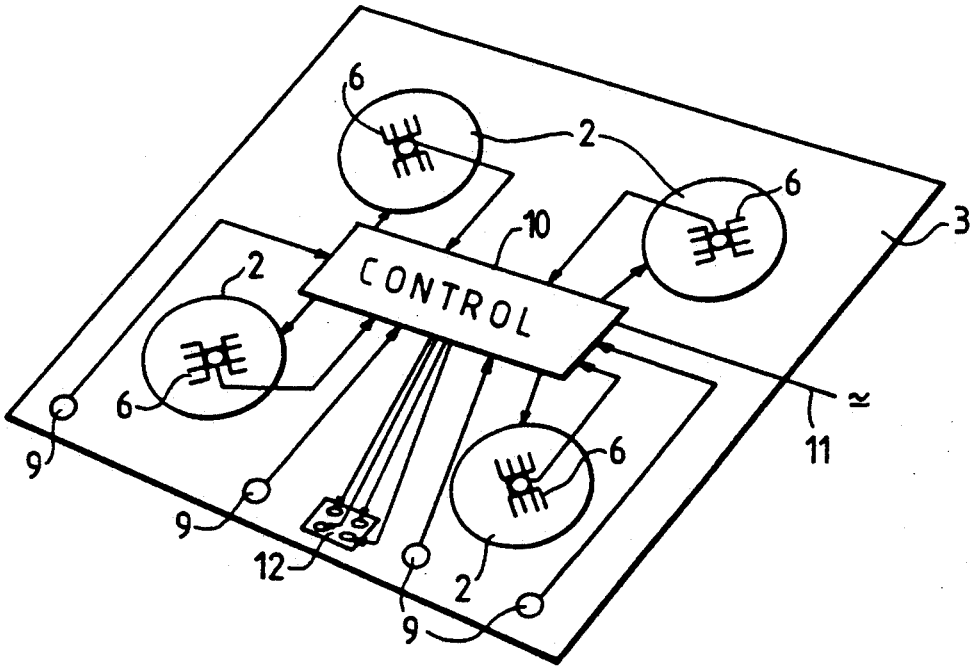
FIG. 11 is a diagram of a cooking hob according to the present invention.

An induction-type cooking hob according to the present invention can be seen in FIG. 11. It goes without saying that the production of cooking ranges also comprising an oven does not depart from the scope of the present invention. In the exemplary embodiment illustrated in FIG. 11, the induction hob comprises four inductors 2. It goes without saying that cooking hobs comprising a different number of inductors 2 do not depart from the scope of the present invention. The inductors 2 are equipped with temperature-measuring devices according to the present invention comprising heat conductors 6. Advantageously, the induction hob according to the present invention comprises a regulating device 10. The regulating device 10 is connected to the supply network 11, to the control devices 9, to the temperature-measuring devices, to the inductors 2 and advantageously to a device 12 for indicating the presence of a residual temperature of the glass-ceramic plate 3.

Figure 12:
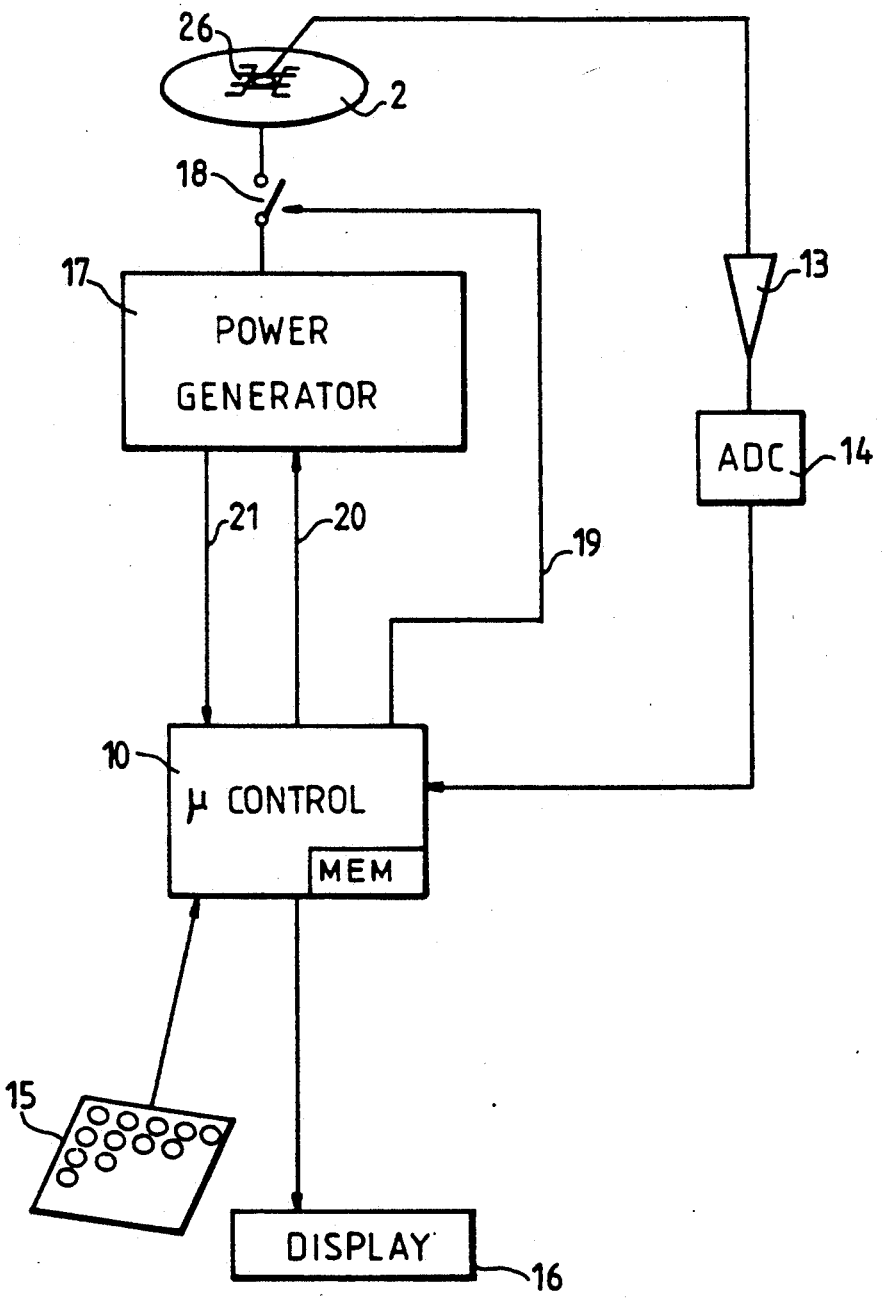
FIG. 12 is a diagram of a regulating device used in the present invention.

An example of a regulating device of known type is illustrated in FIG. 12. The regulating device 10 comprises a regulating microprocessor associated with a permanent memory containing various operating programs. A keyboard 15 makes it possible to enter instructions for the desired cooking. Advantageously, a display 16 connected to the regulating device 10 makes it possible to indicate the selection being made, in order to make the control easier and/or display information relating to the cooking (remaining time, temperature, type of program selected, instantaneous power, energy consumption, etc).

The regulating device 10 is connected to a power generator 17 by means of a line 20 transmitting the power instructions. The power generator 17 is connected to the regulating device 10 by means of a line 21, via which it communicates to it the measurements of current and voltage at the inductors 2. The power generator 17 is connected to the inductor 2 by means of a relay 18 controlled by a line 19 coming from the regulating device 10.

The temperature-measuring device 6 indicates the temperature of the content of a vessel placed on the inductor 2 to the regulating device 10. In the example illustrated, the temperature-measuring device 6 is connected to the input of an amplifier 13. The output of the amplifier 13 is connected to the input of an analog/digital converter 14. The output of the analog/digital converter 14 is connected to the regulating device 10. For the sake of clarity in FIG. 12, only one inductor 2 has been shown. It goes without saying that any number of inductors 2, for example 1, 2, 3, 4, 5 or 6, can be used, without departing from the scope of the present invention.

As a function of the nominal values selected on the control devices 9 and the temperature measurements supplied by the measuring device, the regulating device 10 supplies to the inductors 2 electrical currents of the voltage, intensity and frequency necessary for increasing or maintaining the desired temperature of a saucepan or its content (not shown in FIG. 11).

The control devices 9 are, for example, rotary knobs or pushbuttons making it possible to select the desired cooking rate, power or temperature. They can advantageously be associated with a numerical or alphanumeric display of the selected choice. The residual-heat display device 12 comprises, for example, light-emitting diodes (LED's in English terminology) which light up as long as the temperature of the glass-ceramic plate 3 is higher than 60° C. The device 12 comprises either a single diode or one light-emitting diode for each inductor 2.

The device according to the present invention is used for temperature measurement during induction heating.

The present invention applies mainly to measurements of the temperature of vessels or their content during cooking by the use of induction-type cooking hobs.

We claim:

1. A device for measuring temperature of one of a vessel and a product contained in said vessel wherein said vessel is heated by an induction cooking appliance, said device comprising:

a detector thermally connected to a heat conductor wherein said heat conductor has a geometrical configuration and a material composition which include a plurality of spaced apart extension extending away from said detector for providing a minimized heating in said heat conductor due to said induction cooking appliance and wherein said extensions allow for measurement of the temperature of said one of said vessel and said product independent of a size of said vessel or a configuration of a bottom surface of said vessel.

2. The device according to claim 1 wherein said geometrical configuration of said heat conductor includes interruptions in a plane containing said heat conductor.

3. The device as claimed in any one of claims 1 or 2 wherein said detector is a sensor with a negative temperature coefficient.

4. The device as claimed in claim 3 wherein said sensor is a diode.

5. The device as claimed in claim 1 wherein each of said extensions have a width substantially equal to 2 mm.

6. The device as claimed in any one f claims 1 or 2 wherein said heat conductor is made of aluminum.

7. The device as claimed in any one of claims 1 or 2 wherein said heat conductor is made of copper.

8. A device as claimed in any on of claims 1 or 2 further including a regulating device for regulating current supplied to said induction cooking appliance wherein said regulating device controls the temperature of said one of said vessel and said product to a nominal value.

* * * * *